US005204630A

United States Patent [19]

Seitz et al.

[11] Patent Number: 5,204,630

[45] Date of Patent: Apr. 20, 1993

[54] PREIGNITION WARNING DEVICE

[75] Inventors: William R. Seitz, Birmingham, Mich.; Richard D. Taylor, Findlay; David M. Smith, Fostoria, both of Ohio

[73] Assignee: Allied Signal Inc., Morristown, N.J.

[21] Appl. No.: 721,046

[22] Filed: Jun. 26, 1991

[51] Int. Cl.[5] ..... F02P 17/00

[52] U.S. Cl. ..... 324/399; 340/650

[58] Field of Search ..... 324/399, 395, 393; 73/117.2, 116; 340/664, 650

[56] References Cited

U.S. PATENT DOCUMENTS

| | | | |
|---|---|---|---|
| 4,006,403 | 2/1977 | Olsen et al. | 324/399 |
| 4,291,383 | 9/1981 | Tedeschi et al. | 73/117.2 |
| 4,398,188 | 8/1983 | Feigal et al. | 340/650 |
| 4,558,280 | 12/1985 | Koehl et al. | 324/399 |
| 4,825,167 | 4/1989 | Bayba | 324/393 |
| 4,918,389 | 4/1990 | Schleupen et al. | 324/399 |

*Primary Examiner*—Jack B. Harvey
*Assistant Examiner*—Maura K. Regan
*Attorney, Agent, or Firm*—Leo H. McCormick; Ken C. Decker

[57] ABSTRACT

A device for and method of providing reliable audible and visual warnings of incipient preignition in a combustion chamber is disclosed. The current flow through at least one engine spark plug is monitored at specified times throughout a number of engine revolutions during which there should be no current flow and both an audible alarm and a visible alarm are activated in the event the monitored current flow exceeds a predetermined threshold. Circuitry establishes time intervals during which there should be no current flow through the monitored spark plug and additional circuitry temporarily provides both an audible alarm and a visible alarm for each occurrence of the monitored current exceeding the predetermined threshold. Such a temporary alarm typically has the same duration as the detected excess current. There is also circuitry for continuously enabling both the audible and visible alarms in the event of an excessive number of excessive monitored current flows within a specified length of time.

8 Claims, 9 Drawing Sheets

PREIGNITION WARNING DEVICE

SUMMARY OF THE INVENTION

The present invention relates generally to internal combustion engine monitoring equipment and more particularly to an arrangement for monitoring operation of one or more spark plugs in an engine and providing a warning of impending preignition in sufficient time for to avoid the destructive effects of such preignition.

For optimum performance, it is known that the spark plugs used in an internal combustion engine should be "matched" to that engine. One such matching is to employ the correct heat range spark plug. Spark plugs that conduct heat well to the engine block or head are termed cold while plugs that do not conduct that heat away as rapidly are called hotter plugs. It is desirable to utilize the hottest possible plug in a given engine desirable to avoid fouling of the plug when run at relatively low speeds. The use of a plug that is too hot may result in so-called preignition, a relatively destructive firing of the mixture in the combustion chamber charge too far prior to the time the piston reaches its top dead-center position. If a plug is not sufficiently hot, that is, it conducts heat from the combustion chamber to the cylinder head too well, it will foul at lower speeds. If a plug is too hot, that is, it does not conduct heat away from the combustion chamber sufficiently well, preignition may occur at highway speeds. Due to the safety factors built in by manufacturers, such preignition rarely takes place during normal engine use, but while the manufacturer is testing an engine, and in particular, advancing the spark timing, such preignition may take place and destroy the test engine. Testing when a particular engine is being matched to the correct heat range spark plug is one time that such destructive preignition may occur.

Preignition is not to be confused with detonation or "ping" which not uncommonly occurs (especially when using a lower than desirable octane rated fuel) during normal driving when the normal flame front in the combustion chamber meets up with an abnormal one frequently started by a hot piece of glowing carbon. Preignition should also not be confused with post-ignition or dieseling where fuel continues to be ingested and ignited, e.g., by a piece of glowing carbon, even after the ignition has been shut off. Firing with post-ignition is very late after top dead-center of the piston. These two other conditions are not normally highly destructive to the engine, however, preignition is frequently quite destructive.

Preignition occurs when the charge in the combustion chamber is ignited prior to the spark event (and, therefor, quite a long while prior to top dead-center of the piston). The piston is still on its way up and something within the combustion chamber is hot enough to ignite the combustion charge. Very high pressures and heat are generated and not uncommonly a hole can be blown through the piston. Typically, when an operator becomes aware of preignition, it is too late to prevent damage to the engine.

In determining the correct heat range plug for an engine, it is important to know when preignition would occur and then build in a safety factor in the plug actually used. The engine is sequentially run with sets of several different heat range plugs and the specific spark advance angle where preignition begins is determined for each set of plugs. Thereafter the set of plugs with adequate safety factor is selected. There are presently three basic ways used to test the heat range of a set of plugs. During dynamometer testing, there is a correlative drop in engine torque as preignition is approached, but it is extremely difficult to determine exactly when to shut down the engine to prevent damage. It is also known to simply run an engine at early spark event and then interrupt the spark and count the number of times the cylinder continues to fire from a still too hot plug. Neither of these two schemes are very accurate. It is also known that as the timing is advanced more and more, the plug begins to get warmer and warmer. If a bias is applied to the plug, gas near the plug electrodes will begin to ionize and a current will begin to flow just prior to preignition. Engines have been run up to the preignition point using an oscilloscope to watch for this ionization current and many of those engines have been lost, not because the tell-tale current did not begin to flow, but because the operator failed to recognize that the current had commenced.

Among the several objects of the present invention may be noted the provision of a relatively safe system for determining the correct heat range spark plug for an internal combustion engine; the provision of apparatus for and a method of detecting incipient preignition in an engine combustion chamber; the provision of an early warning of impending preignition thereby allowing more time to avoid engine damage; the provision of a preignition warning device having both visual and audible alarms announcing incipient preignition; the provision of preignition warning device which looks for spark plug ionization current flow just prior to preignition; the provision of a highly reliable preignition warning device; and the provision of a preignition warning device operable with either conventional ignition systems or distributorless ignition systems. These as well as other objects and advantageous features of the present invention will be in part apparent and in part pointed out hereinafter.

In general, a method of operating a spark ignited internal combustion engine includes the application of a relatively low voltage across a spark plug associated with at least one engine cylinder in conjunction with monitoring the current flow through said spark plug. A time interval is established during which there should be no current flow through the monitored spark plug and both an audible alarm and a visible alarm are enabled in the event the current flow associated with the monitored plug exceeds a predetermined threshold during the established time interval. Both the audible alarm and the visible alarm are temporarily enabled for each occurrence of the current exceeding the predetermined threshold and both alarms are continuously enabled in the event of an excessive number of excessive current flows during the corresponding time intervals occurring within a specified length of time. The engine is typically a multi-cylinder engine and at least one spark plug associated with each engine cylinder has a relatively low voltage applied there across. A plurality of time intervals, one set of intervals for each such spark plug, are established during which there should be no current flow through the associated spark plug. The established time intervals may comprise intervals of uniform duration immediately preceding the spark event for the associated spark plug. Typically, the sets of time intervals for any two spark plugs are disjoint, that is, there is no time during which current flow is being simultaneously monitored in any two spark plugs.

Each spark plug is monitored so as to provide an alarm indication in the event a spark plug associated with any cylinder has an excessive number of excessive current flows during its corresponding time intervals.

BRIEF DESCRIPTION OF THE DRAWINGS

FIG. 1(*a*) is a block diagram of the preignition warning device for operating an ignition system with a mechanical distributor;

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
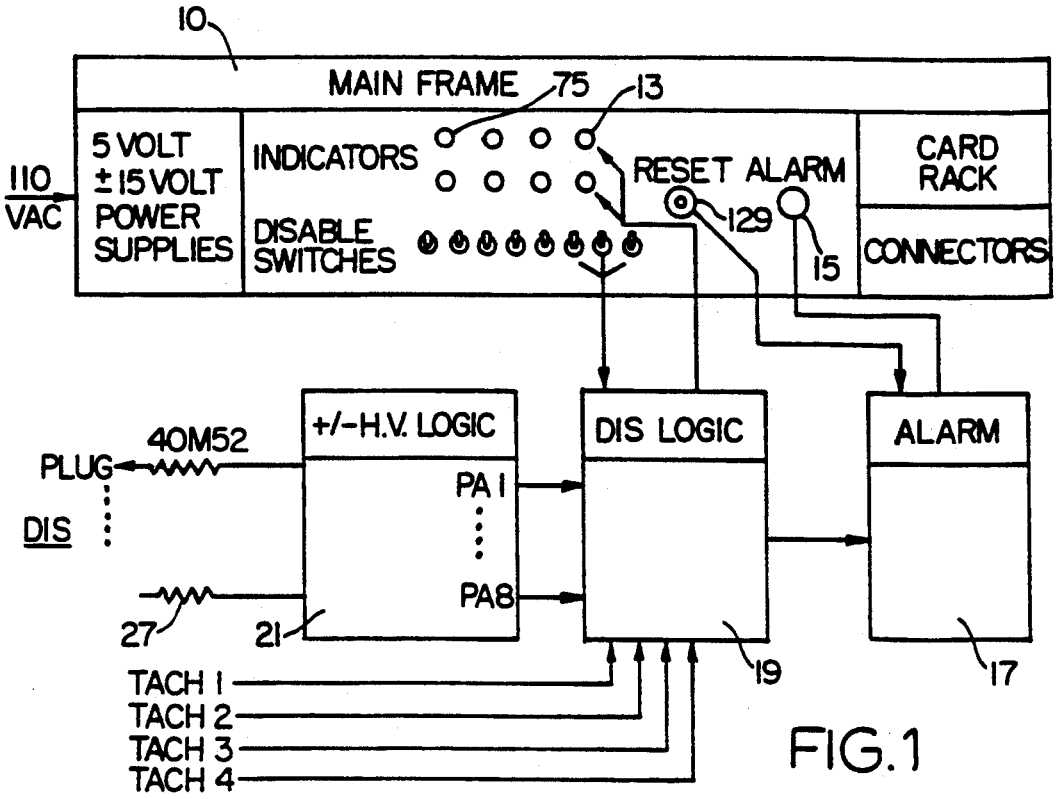
FIG. 1 is a block diagram of a preignition warning device set up for operation with a distributorless ignition system according to the present invention.
Figure 1A:
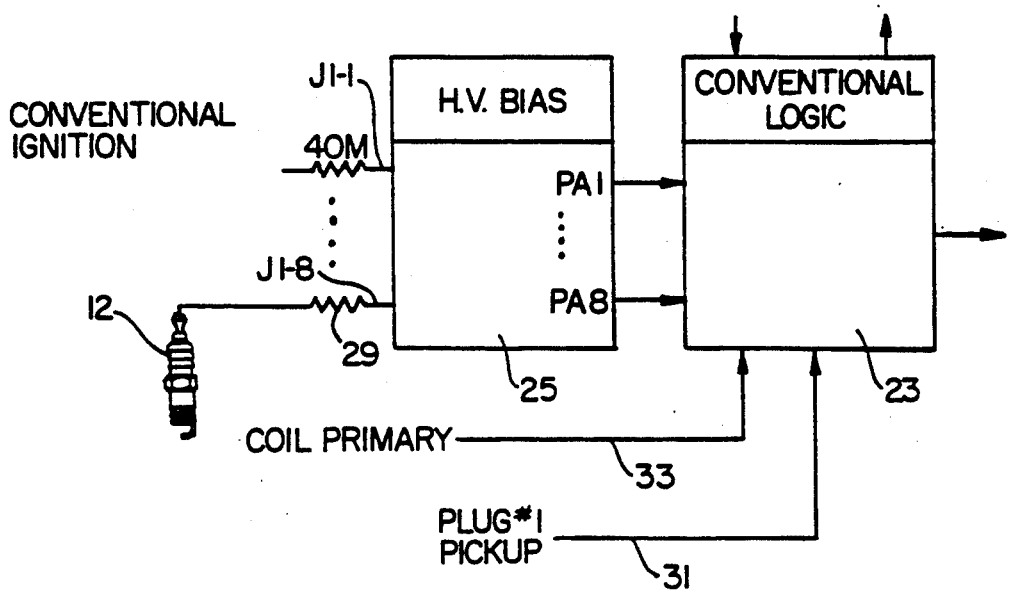

FIG. 1 is a somewhat functional depiction of the preignition detector system set up for one common form of distributorless ignition system while FIG. 1*a* illustrates the components utilized in conjunction with FIG. 1 for conventional ignition systems. The main frame 10 and alarm board 17 (FIG. 4) are common to both systems while the distributorless system utilizes the DIS (distributorless ignition system) logic board 19 (FIG. 6) and DIS high voltage bias circuit 21 (FIG. 5) while the conventional ignition system utilizes the conventional ignition logic board 23 (FIG. 3) and conventional high voltage bias circuit 25 (FIG. 7) as substitutes for their like-named counterparts. In each case, the high voltage bias circuitry 21 or 25 is coupled to the engine spark plugs by way of a series of high resistance, e.g., 40 megohm, protective resistors 27 or 29.

Figure 2:
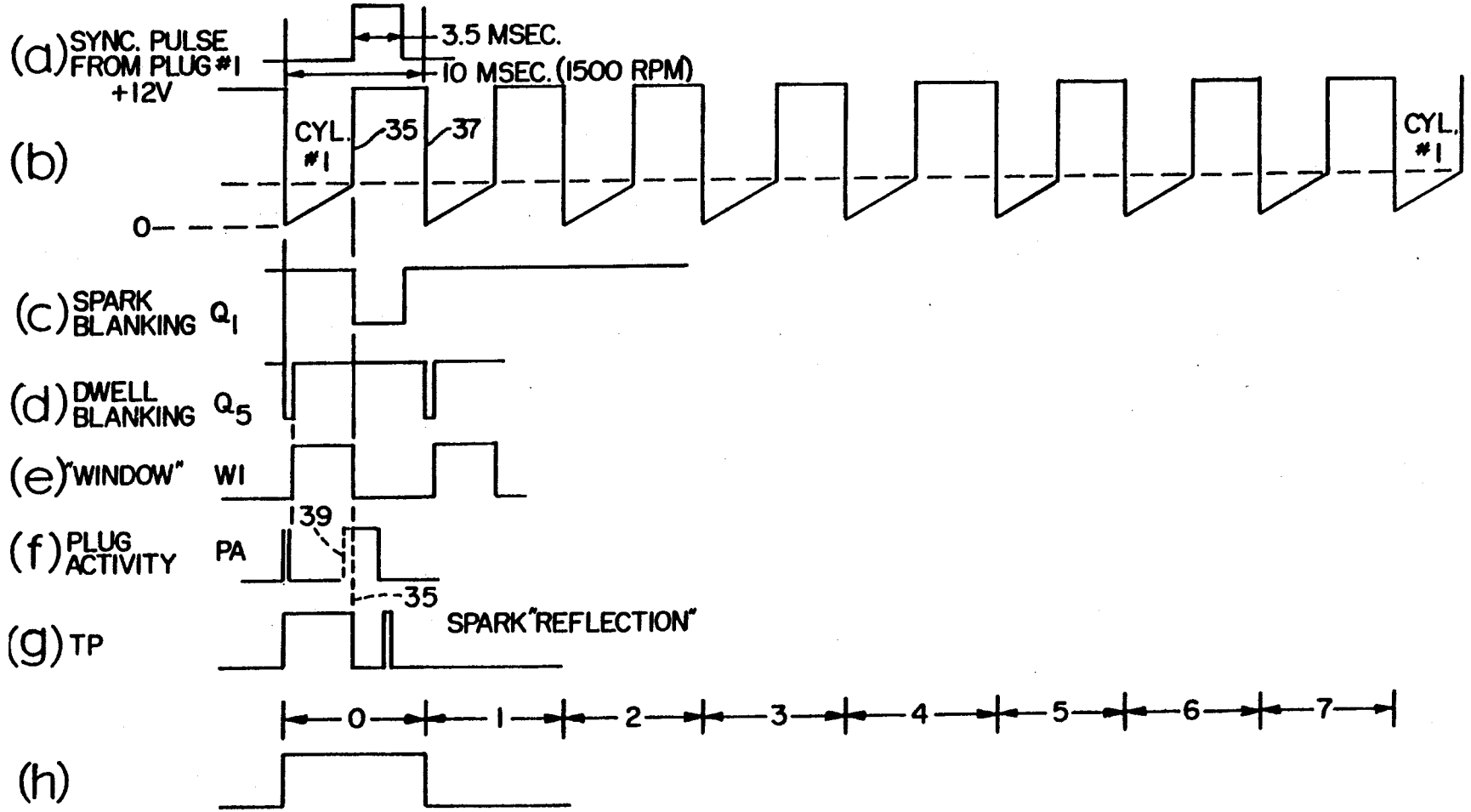
FIG. 2 is a series of waveforms helpful in understanding the conventional ignition system.
Figure 3A:
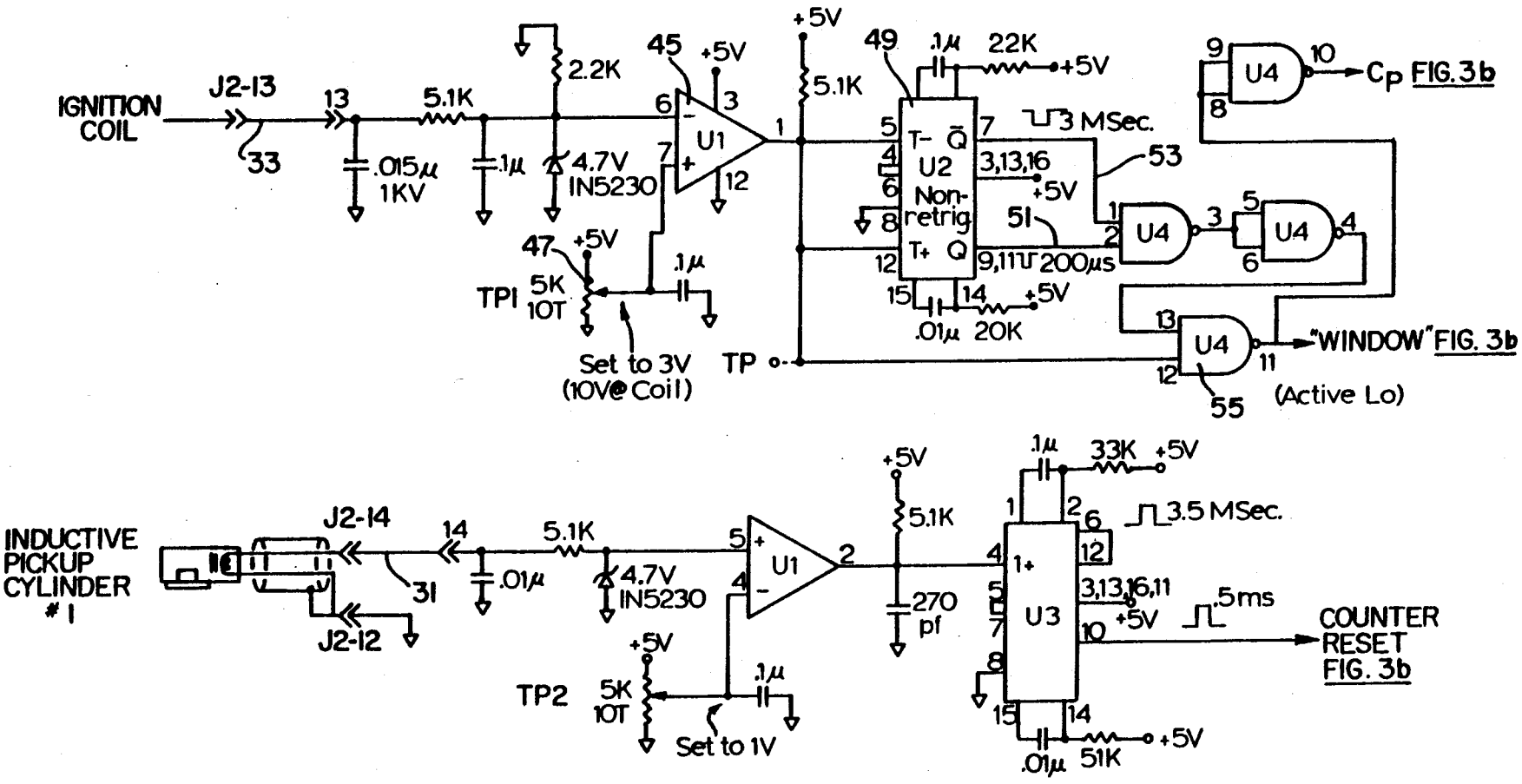
FIGS. 3(*a*) and 3(*b*) is a detailed schematic circuit diagram of the conventional ignition logic of FIG. 1*a*.
Figure 3B:
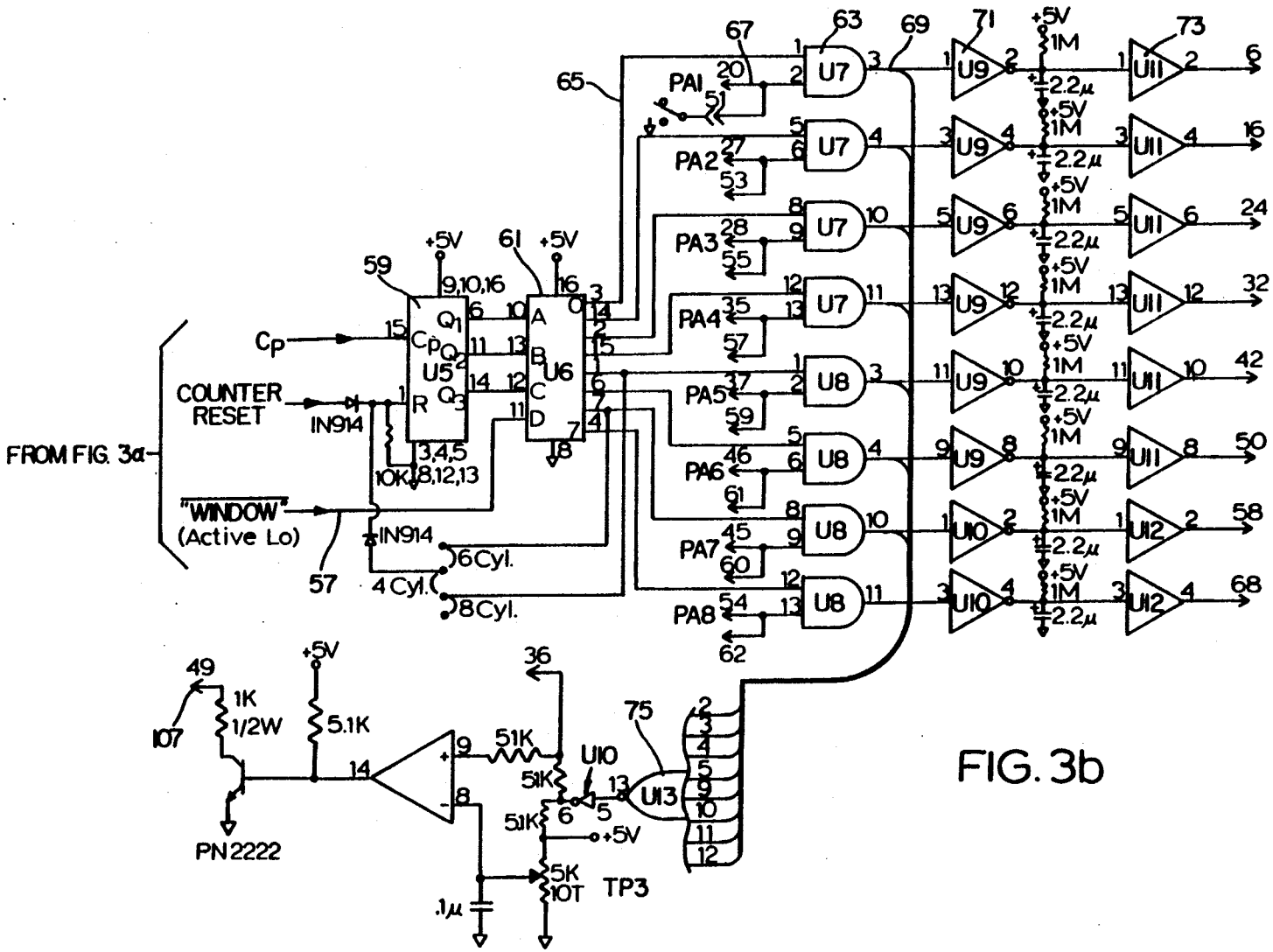

Comparing FIGS. 1*a*, 2 and 3, the waveform (a) is the reference pulse for the reference cylinder number one and appears on line 31 while waveform (b) is the ignition coil primary current as appears on line 33. As the electronic switching operates, the voltage on the primary goes to zero and then it ramps up a little bit. When it is time to make a spark, the ignition points open and the voltage jumps to perhaps three or four hundred volts at 35 (not shown) and this primary voltage is multiplied by the ignition turns ratio (typically about 100:1) to provide the ignition voltage across the spark plug for the spark event. After a time delay, the points close again for the next cylinder at 37. The circuitry of the present invention is looking for any leakage current right before the spark event during a time period when there should be no leakage. The circuitry also filters out unwanted "noise" such as the normal, but unwanted spark reflection pulse of waveform (g). This time when no leakage current should flow is represented by the positive portion of the "window" pulse of waveform (e). Waveform (f) illustrates plug activity which should commence at 35. If there is ionization leakage current appearing sooner as shown by the dotted line 39 which falls within the window of waveform (e), the system will recognize it. Thus, plug activity during the window period is indicative of preignition.

Turning now primarily to FIG. 3, the waveform (b) as appears on line 33 is compared (and inverted) at 45 to a threshold as set by potentiometer 47 and the waveform then fed to a single-shot 49. This circuit generates a delay on line 51 so that for the first 200 microsecond of dwell (points closed) during which plug activity is ignored. This circuit also generates a 3 millisecond spark event ignoring pulse on line 53. The waveforms on lines 51 and 53 are shown as waveforms (d) and (c) respectively in FIG. 2. Waveforms (c), (d) and (g) are combined in the inverting AND gates such as 55 to provide an active low window signal on line 57. The inductive pickup signal, waveform (a), on line 31 is supplied by way of amplifying and wave shaping circuitry to the reset of the three bit counter 59 which basically counts the number of cylinder firings and the counter output is supplied to decoder 61 which, in turn, supplies a cylinder identifying signal on one of its eight output lines to one of the AND gates 63. Thus, for example, the signal on line 65 is only high during cylinder #1's window period. While the window pulse is repetitive, the counter allows this pulse to be distributed among the several cylinders. The other input to the several AND gates 63 is waveform (f) plug activity. For example, if these is plug activity on line 67 and if plug #1 is active and if these occur during the window pulse, there will be an output on line 69 which is supplied by way of inverting amplifier 71 and pulse stretching (filter) circuitry to a LED driver 73 to momentarily enable the cylinder #1 visual indicator 76 on the front panel of FIG. 1. The outputs of the several AND gates 69 are supplied to an OR gate 75 which will momentarily enable the audible alarm 15 in the event of preignition indicated by leakage current through any one of the spark plugs.

Figure 7:
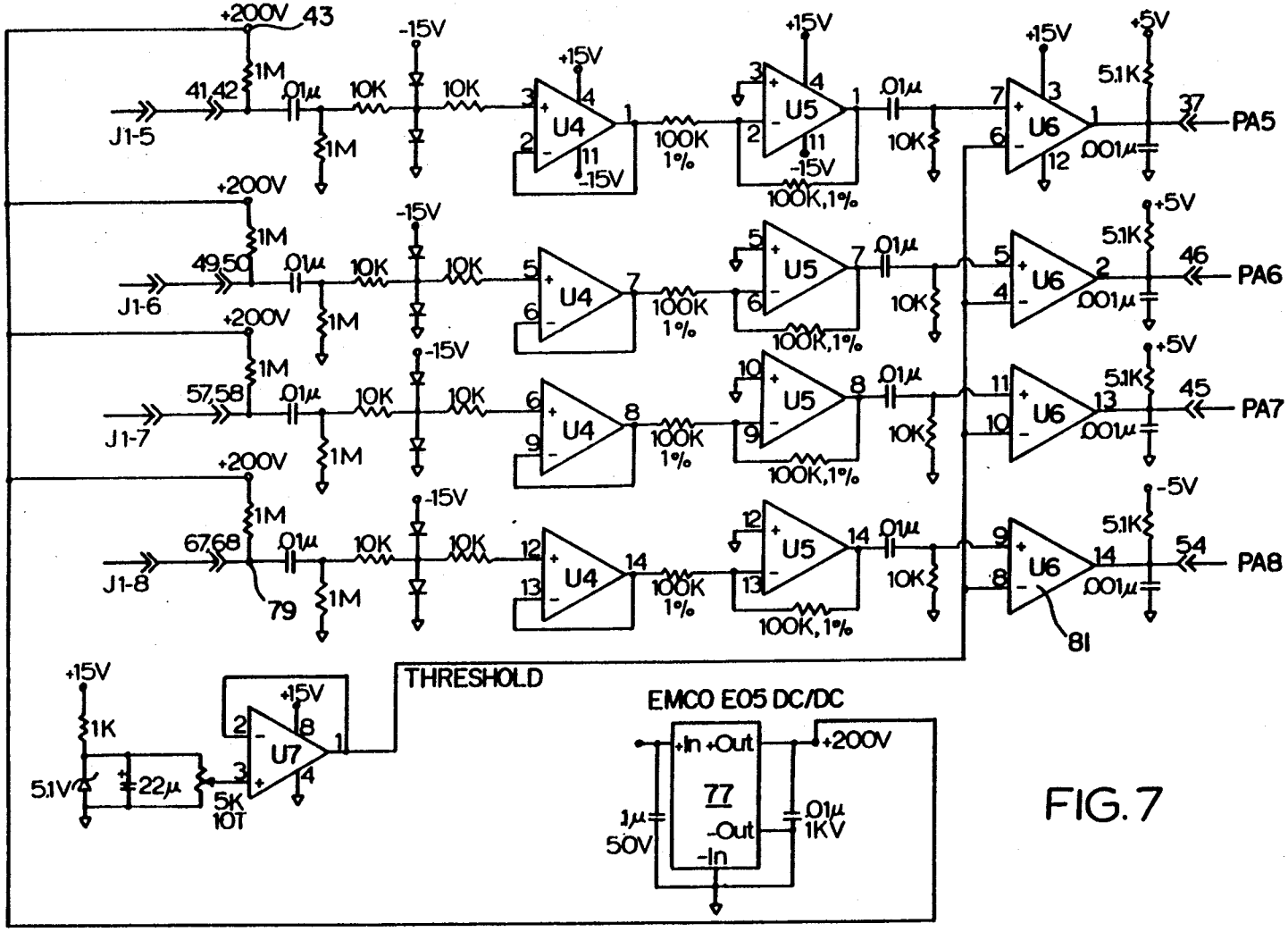
FIG. 7 is a detailed schematic diagram of the high voltage bias portion of FIG. 1(*a*).

The circuitry which senses plug activity and supplies waveform (f) signals to the AND gates 63 is shown in FIG. 7. A DC to DC converter 77 provides approximately 200 volt bias which is supplied by way of the lines j1-1 through j1-8 to the 40 megohm resistors 29 and to the spark plugs such as 12. FIG. 7 shows four of the typically eight identical channels for an eight cylinder engine. Any time there is a change in the current flowing in the resistor 29, there will be a change in the voltage at point 79. This change is transmitted by way of some protective filtering circuity, diodes and amplifiers to the comparator 81 where it is compared to a threshold of about 0.1 volts from the amplifier 83 and the output from the comparators such as 81 provides a logic signal indicative of plug activity to the AND gates 63 of FIG. 3.

Figure 5:
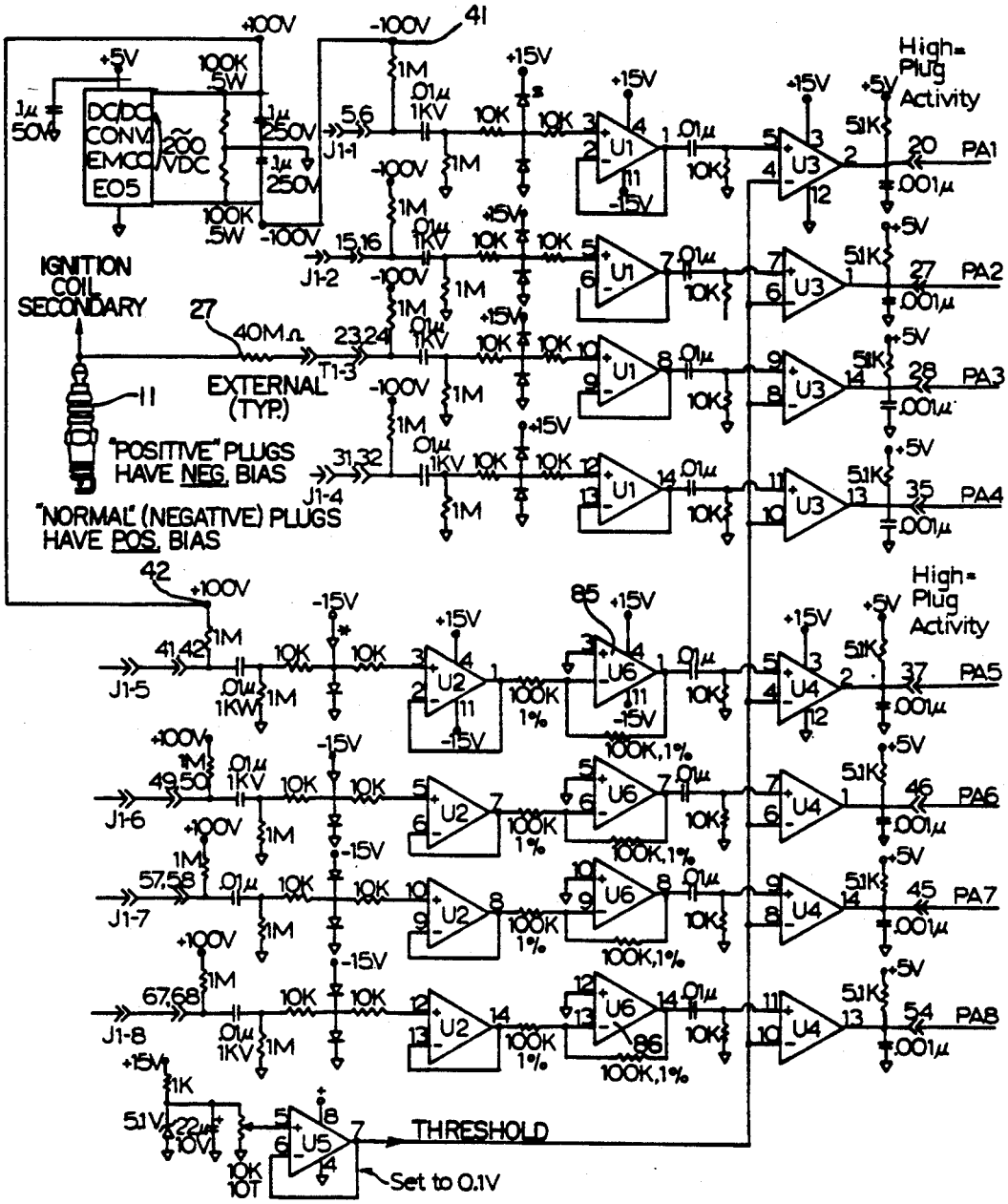
FIG. 5 is detailed schematic diagram of the high voltage bias portion of the circuit of FIG. 1.

The principles of the illustrated distributorless ignition system case are the same. The primary difference in detecting plug activity is that half the spark plugs have a negative voltage and half have a positive voltage for creating the spark. The circuitry compensates for this fact by inverting half the waveforms. It will be noted that FIG. 7 and the upper half of FIG. 5 are substantially identical. In the lower half of FIG. 5, a series of inverting amplifiers 85, 86 have been introduced, but the remainder of the circuitry is the same as the top half. Also, the test voltage applied to the spark plugs is negative at terminal 41 (for the positive sparking plugs) while it is positive at terminal 42 (for the negatively sparking plugs).

Figure 6A:
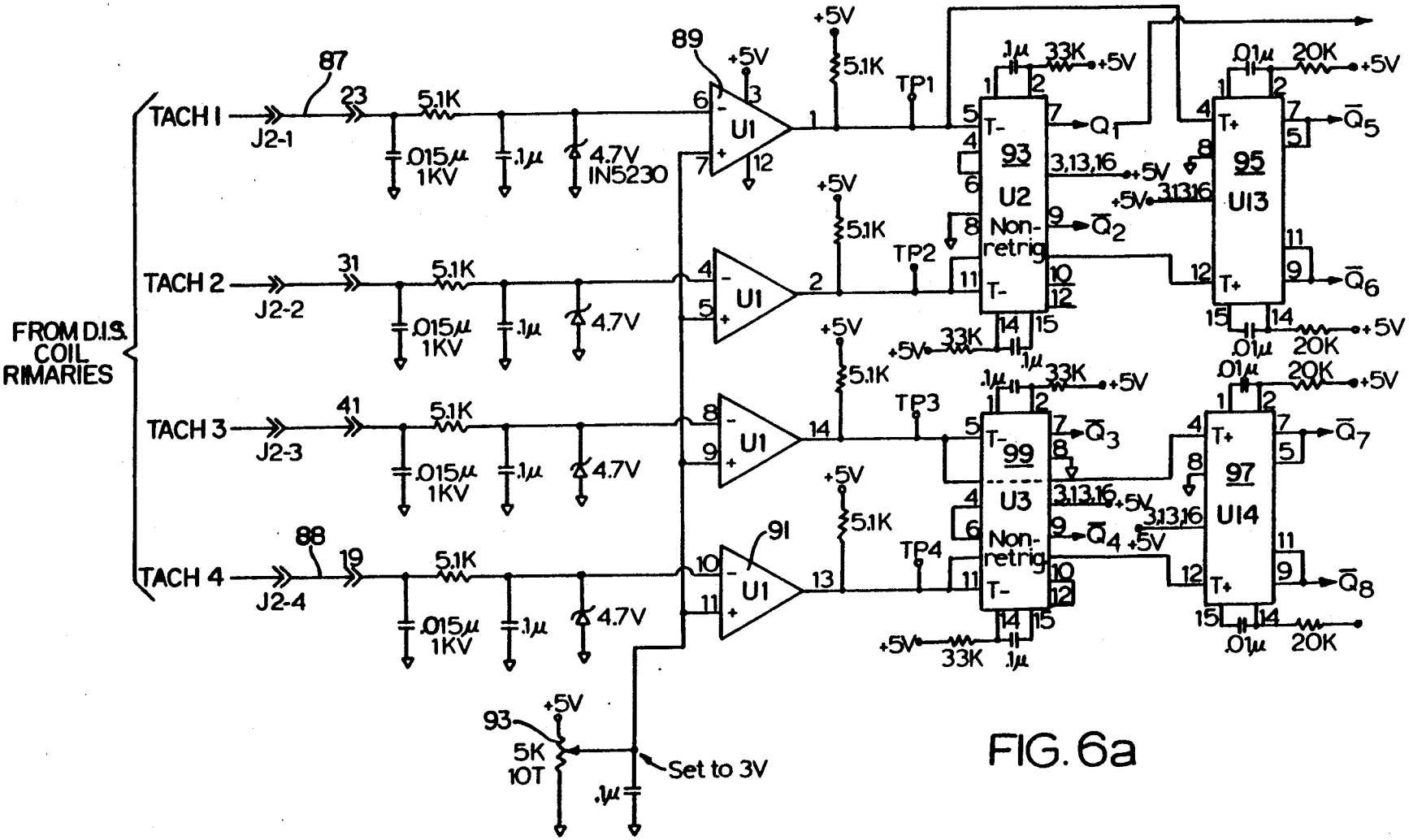
FIG. 6(*a*) and 6(*b*) is a detailed schematic diagram of the logic portion of FIG. 1.
Figure 6B:
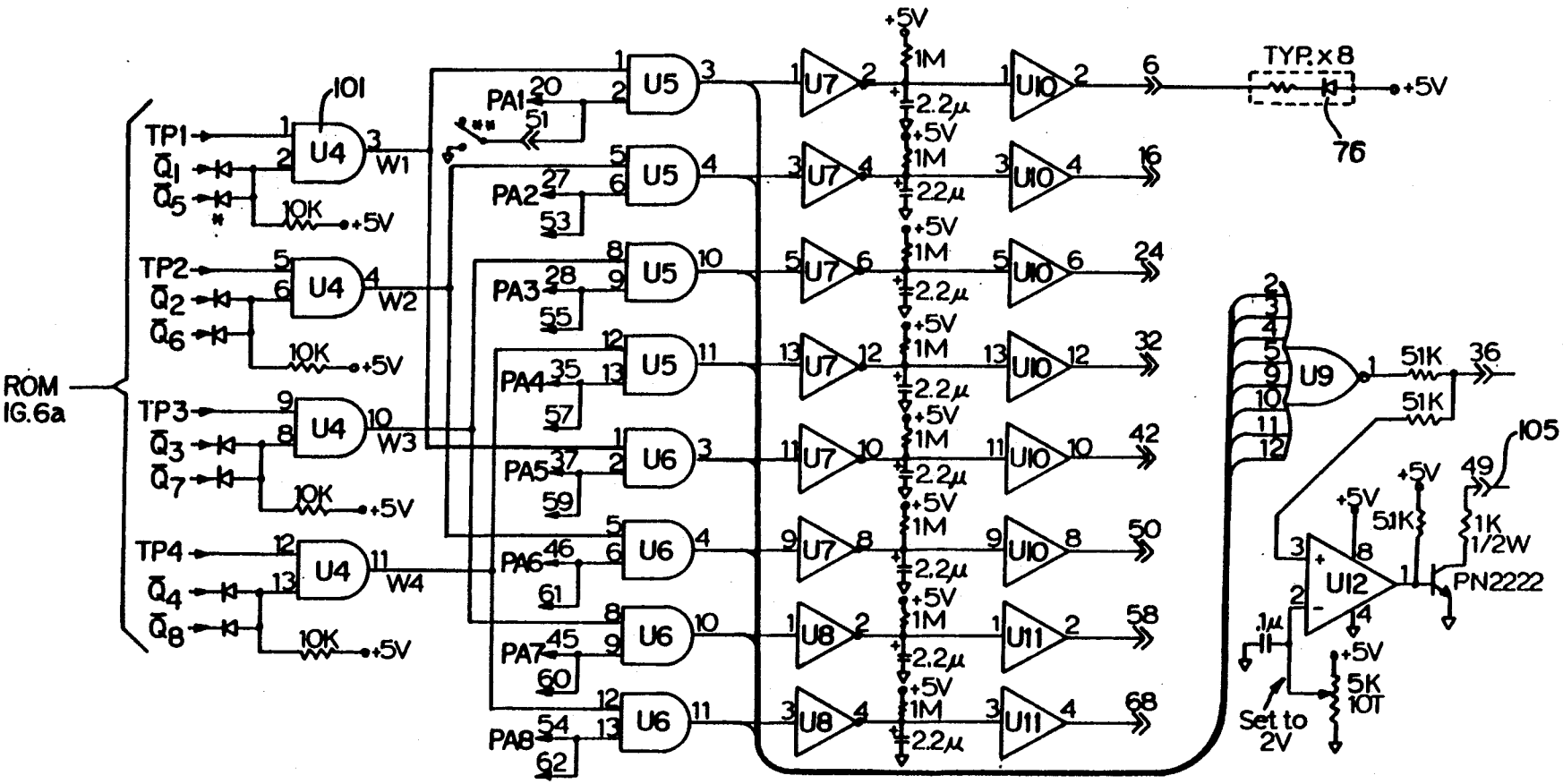

The DIS logic board of FIG. 6 differs significantly from its conventional counterpart of FIG. 3. The particular DIS system utilizes four coils for an eight cylinder engine and those four coil signals are input on line 87, 88. The four coil signals are handled much the same as the single coil signal was in FIG. 3. A set of four comparators 89, 91 compare the incoming signals to a threshold set by potentiometer 93 just as comparator 45 did in FIG. 3 and the waveform is then fed to a set of four single-shots 93, 95, 97 and 99 all similar to the single-shot 49 of FIG. 3 to create spark blanking and dwell blanking signals for each coil. The counter 59 and decoder 61 are no longer necessary because some separation or identification of cylinder is inherent in the four separate channels. The AND gates such as 101 create four separate windows.

The method of operating a spark ignited internal combustion engine according to the techniques of the present invention should now be clear. A relatively low voltage, such as from terminals 41 or 43 is applied across at least one spark plug 11 associated with at least one of the cylinders and the current flow through that plug is monitored, for example, by measuring the voltage drop across the large resistors 27 or 29. Typically all cylinders are monitored. Time intervals are established during which there should be no current flow through the monitored spark plug and an alarm 13 or 15 is activated in the event the current flow associated with the monitored plug exceeds a predetermined threshold within the established time intervals a predetermined number of times within a specified length of time. In a presently preferred embodiment, the circuit searches for (and considers indicative of incipient preignition) three excessive current measurements for any spark plug in the engine within a five second time interval. The engine is typically a multi-cylinder engine and at least one spark plug associated with each engine cylinder has a relatively low voltage applied there across. A plurality of time intervals (FIG. 2*e*) one set of intervals for each such spark plug, are established during which there should be no current flow through the associated spark plug. Each spark plug is similarly monitored to thereby provide an alarm indication in the event a spark plug associated with any cylinder has an excessive number of excessive current flows during its corresponding time intervals for any two spark plugs are disjoint, i.e. a separate "window" is established for each cylinder as seen in FIG. 2*e*. These established time intervals comprise intervals of uniform duration immediately preceding the spark event for the associated spark plug.

Figure 4:
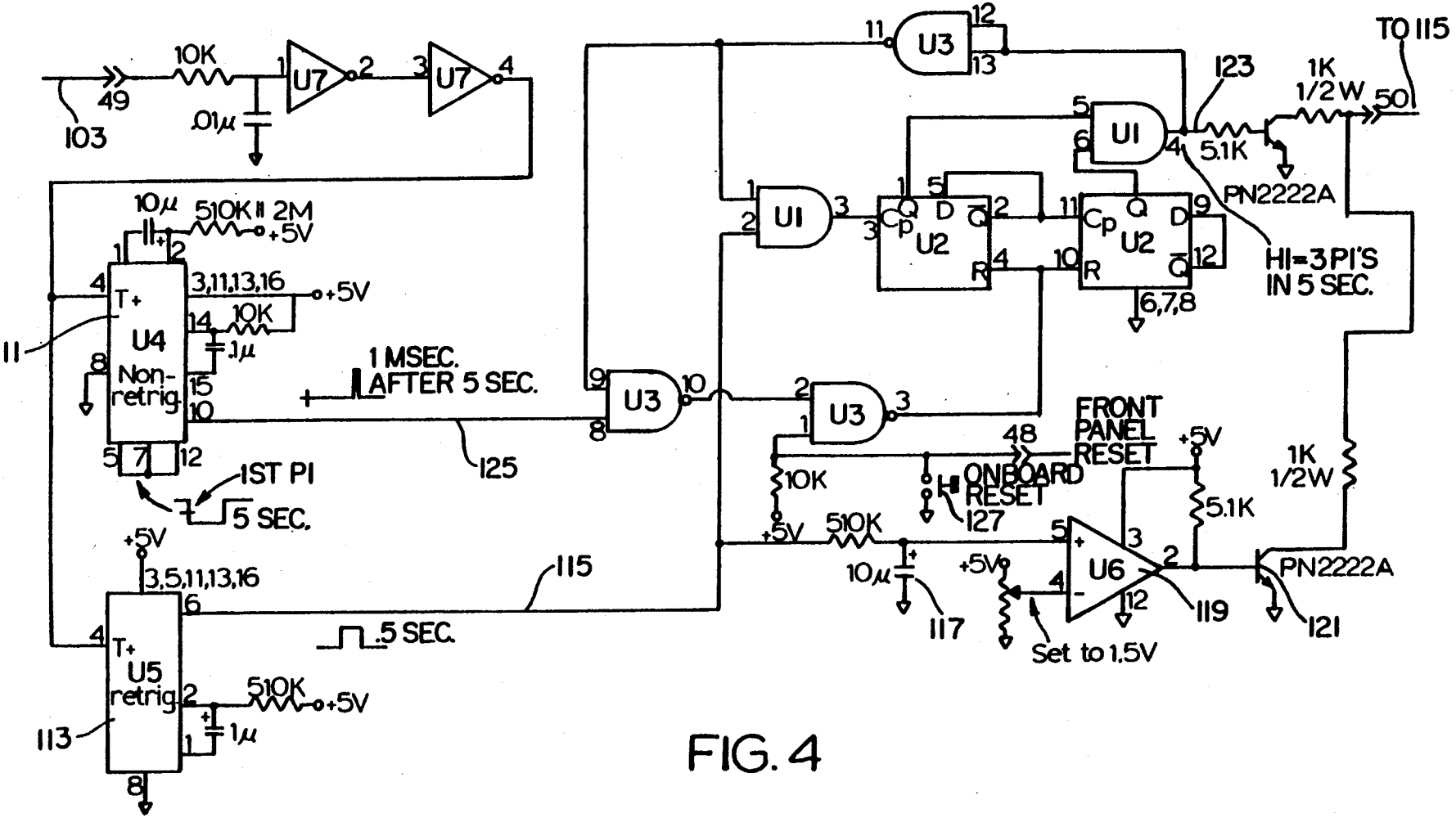
FIG. 4 is a detailed schematic diagram of the alarm portion of FIG. 1.

The alarm 17 may be activated in two stages including a first stage of temporarily enabling both a visible indication 13 and an audible indication 15 for each occurrence of the current exceeding the predetermined threshold for each spark plug being monitored and a second stage of continuously enabling the audible in the event a spark plug associated with any cylinder has at least the excessive number (for example, three) of excessive current flows during its corresponding time intervals and within the specified length of time (for example, five seconds). The circuitry for accomplishing this continuous alarm is shown in FIG. 4 and receives an input for each temporary indication on line 103 from either terminal 107 of the conventional system or 109 of the DIS system. These signals pass through a filter and inverting amplifiers into a timer 111 the top half of which is set up for a five second time period. The alarm signals are also passed through pulse stretching circuit 113 to provide a one-half second duration pulse on line 115. A high repetition rate of pulses on this line will build up a charge on capacitor 117 and comparator 119 will turn on the transistor 121 and enable a "beeper". The remaining several AND gates and flip-flop function as a counter which if it receives three alarm signals within five seconds, will go high on line 123 and trigger the continuous audible alarm until reset by switch 127 or 129. Every five seconds after the first trigger signal is received, a reset signal on line 125 returns the count to zero and the circuit begins anew to search for three alarms in a five second interval.

From the foregoing, it is now apparent that a novel preignition detecting arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

I claim:

1. A method of evaluating the operation of a spark ignited internal combustion engine including the steps of:

applying a relatively low voltage across at least one spark plug associated with at least one cylinder in said engine;

monitoring the current flow through said spark plug;

establishing a time interval during which there should be no current flow through said spark plug, said established time interval being of uniform duration immediately preceding a spark event for said spark plug;

deriving an alarm signal whenever the current flow associated with said spark plug exceeds said predetermined threshold within said established time interval;

temporarily enabling both visible and audible indicators by said alarm signal to inform an operator of an initial excessive current flow condition in said spark plug which could damage said engine;

counting the number of times said current flow though said spark plug exceeds said predetermined threshold level; and summing said number of times said predetermined threshold level exceeds a predetermined number in a specified length of time to create a cumulative signal for continuously enabling at least said audible indicator.

2. The method of evaluating the operation of a spark ignited internal combustion engine in accordance with claim 1 wherein the engine is a multi-cylinder engine having a spark plug associated with each cylinder and a uniform time interval is established for each spark plug during which no current flow should through each spark plug, further including the step of:

monitoring each spark plug to thereby provide said visible indicator with an individual signal for each spark plug corresponding to an alarm signal.

3. The method of evaluating the operation of a spark ignited internal combustion engine in accordance with claim 2 wherein the current flow is monitored for at least two spark plugs.

4. The method of evaluating the operation of a spark ignited internal combustion engine in accordance with claim 1 wherein said cumulative number of alarm signals is three and the specified length of time is five seconds.

5. A method of evaluating the operation of a spark plug ignited internal combustion engine including the steps of:

applying a relatively low voltage across a spark plug associated with at least one engine cylinder;

monitoring the current flow through said spark plug;

deriving an initial alarm signal from the monitored current flow whenever the current flow immediately preceding a spark event exceeds a predetermined threshold;

temporarily enabling both a visible indicator and an audible indicator by said initial alarm signal to inform an operator of the occurrence of current flow associated with said monitored plug which exceeds said predetermined threshold which could damage said engine;

counting the number of times the current flow through said spark plug exceeds said predetermined threshold level in a predetermined time interval; and summing said number of times said predetermined threshold level is exceeded in said predetermined time interval to develop a cumulative signal to continuously enable at least said audible indicator when a cumulative number exceeds a predetermined number in a specified length of time to inform an operator of an impending condition that could permanently damage said engine.

6. The method of evaluating the operating a spark ignited internal combustion engine in accordance with claim 5 wherein the engine is a multi-cylinder engine with a spark plug associated with each cylinder further including the step of:

monitoring each spark plug in the multi-cylinder engine to provide an alarm indication in the event any spark plug experiences an excessive number of excessive current flows.

7. The method of operating a spark ignited internal combustion engine in accordance with claim 5 wherein the current flow is monitored for any two spark plugs in a multi-cylinder engine.

8. A preignition warning system for use in evaluating the operation of a spark plug in engine comprising:

means for monitoring the current flow through at least one engine spark plug at specified times throughout a number of engine revolutions;

means for establishing time intervals during which there should be no current flow through the monitored spark plug, said established time intervals being of uniform duration and immediately preceding a spark event for said spark plug corresponding to the rate of the engine revolutions;

means for monitoring the current flow through said spark plug;

means for deriving an alarm signal whenever the current flow through said spark plug exceeds a predetermined threshold;

means for temporarily enabling both a visible indicator and an audible indicator by said alarm signal to inform an operator of the occurrence of current flow through said spark plug in excess of said predetermined threshold which may damage said engine;

means for counting the number of times said alarm signal occurs in a predetermined time interval;

means for summing the number of times said alarm signal occurs in said predetermined time interval to create a cumulative signal; and means responsive to said cumulative signal for continuously enabling at least said audible indicator whenever said cumulative number of alarm signals exceeds a predetermined number during a specified length of time.

* * * * *